US006276281B1

(12) United States Patent
Mesalic et al.

(10) Patent No.: US 6,276,281 B1
(45) Date of Patent: Aug. 21, 2001

(54) METHOD AND APPARATUS FOR CONTROL OF A RAIL CONTAMINANT CLEANING SYSTEM

(75) Inventors: Admir Mesalic; Arthur Lee Wheeler, both of Erie; Bret Dwayne Worden, Union City; Ajith Kuttannair Kumar; Mirza Aref Ahmed Baig, both of Erie, all of PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/398,295

(22) Filed: Sep. 20, 1999

(51) Int. Cl.[7] ..... B61F 19/00
(52) U.S. Cl. ..... 104/279
(58) Field of Search ..... 104/279, 280; 303/7; 291/2

(56) References Cited

U.S. PATENT DOCUMENTS

| | | | |
|---|---|---|---|
| 77,602 | 5/1868 | Floyd . | |
| 161,718 | 4/1875 | Waterbury . | |
| 184,628 | 11/1876 | Kendrick . | |
| 1,192,808 | 7/1916 | Allen . | |
| 1,432,352 | 10/1922 | Moricca . | |
| 2,543,166 | 2/1951 | Heining . | |
| 2,560,221 | 7/1951 | Hamblin . | |
| 2,566,473 | 9/1951 | Wilson . | |
| 2,597,719 | 5/1952 | Foster . | |
| 2,756,520 | 7/1956 | Soule . | |
| 3,270,632 | 9/1966 | Schultz . | |
| 3,391,025 | 7/1968 | Foxx et al. . | |
| 3,685,454 | 8/1972 | Ogilvy et al. . | |
| 4,230,045 * | 10/1980 | Fearon | 104/279 |
| 6,089,831 * | 7/2000 | Bruehmann et al. | 303/7 |

* cited by examiner

*Primary Examiner*—S. Joseph Morano
*Assistant Examiner*—Robert J. McCarry, Jr.
(74) *Attorney, Agent, or Firm*—Jill M. Breedlove; Carl A. Rowold

(57) ABSTRACT

An apparatus and method for clearing a railroad track of contaminants, such as snow, including a control system for providing control signals to a compressed air system mounted on a locomotive based on a plurality of predetermined conditions. A learning system evaluates the effects of railroad track clearing and provides input for activating the railroad track clearing system.

9 Claims, 3 Drawing Sheets

METHOD AND APPARATUS FOR CONTROL OF A RAIL CONTAMINANT CLEANING SYSTEM

BACKGROUND OF THE INVENTION

This invention relates to the control of a contaminant cleaning apparatus, particularly with regard to clearing rails of snow.

The use of compressed air to clean the rail in a railroad system goes back to the 1800s. The cleaning of the rail is very important for better adhesion performance between the locomotive wheel and the rail. There is a need for a rail cleaning system that effectively minimizes the on-time of the rail cleaning device to reduce air compressor wear by disabling the device when it is not needed. There is a need for the rail cleaning system to recognize the conditions during which the system should be engaged. The system should also be capable of learning whether it should be on or off as conditions change.

U.S. Pat. No. 77,602 issued on May 5, 1868 to Floyd describes the use of steam from the boiler of a locomotive that is directed onto the rails prior to the traction wheels of the locomotive. This steam blows and melts any snow or ice off the rails prior to contact by the traction wheels to the rails, thus improving the grip of the wheels onto the rails.

U.S. Pat. No. 2,597,719 by Foster, issued on May 20, 1952, describes a track cleaning apparatus mounted to a locomotive to effectively remove all foreign matter that may accumulate on the rails in advance of the traction wheels, particularly snow. The purpose is to clean the rails of bulk contaminants for the purpose of getting sand directly on top of the rail in position for effective contact between the wheel and the rail. Foster describes a system of blowing heated air and heated compressed air directly onto the tracks to melt the snow or ice and removal of the snow or ice.

Locomotives and transit vehicles as well as other large traction vehicles are commonly powered by electric traction motors coupled in driving relationship to one or more axles of the vehicle. Locomotives and transit vehicles generally have at least four axle-wheel sets per vehicle with each axle-wheel set being connected via suitable gearing to the shaft of a separate electric motor commonly referred to as a traction motor. In the motoring mode of operation, the traction motors are supplied with electric current from a controllable source of electric power (e.g., an engine-driven traction alternator) and apply torque to the vehicle wheels which exert tangential force or tractive effort on the surface on which the vehicle is traveling (e.g., the parallel steel rails of a railroad track), thereby propelling the vehicle in a desired direction along the right of way. Good adhesion between each wheel and the surface is required for efficient operation of the vehicle.

It is well known that maximum tractive or braking effort is obtained if each powered wheel of the vehicle is rotating at such an angular velocity that its actual peripheral speed is slightly higher (motoring) than the true vehicle speed (i.e., the linear speed at which the vehicle is traveling, usually referred to as "ground speed" or "track speed"). The difference between wheel speed and track speed is referred to as "creepage" or "creep speed." There is a variable value of creepage at which peak tractive effort is realized. This value, commonly known as the optimal creep setpoint is a variable that depends on track speed and rail conditions. So long as the allowable creepage is not exceeded, this controlled wheel slip is normal and the vehicle will operate in a stable microslip or creeping mode. If wheel-to-rail adhesion tends to be reduced or lost, some or all of the vehicle wheels may slip excessively, i.e., the actual creep speed may be greater than the maximum creep speed. Such a gross wheel slip condition, which is characterized in the motoring mode by one or more spinning axle-wheel sets, can cause accelerated wheel wear, rail damage, high mechanical stresses in the drive components of the propulsion system, and an undesirable decrease of tractive effort.

The peak tractive effort limits the pulling/braking capability of the locomotive. This peak tractive effort is a function of various parameters, such as weight of the locomotive per axle, wheel rail material and geometry, and contaminants like snow, water, grease, insects and rust. Contaminants in the wheel/rail interface reduce the maximum adhesion available, even at the optimal creep setpoint.

In a normal motoring or propulsion mode of operation, the value of the engine speed call signal is determined by the position of a handle of a manually operated throttle. A locomotive throttle conventionally has eight power positions or notches (N), plus idle and shutdown. N1 corresponds to a minimum desired engine speed (power), while N8 corresponds to maximum speed and full power. In a consist of two or more locomotives, only the lead unit is usually attended, and the controller onboard each trail unit will receive, over a trainline, an encoded signal that indicates the throttle position selected by the operator in the lead unit. The eight discrete power notches described above may be replaced by a continuously variable controller. For each power level of the engine, there is a corresponding desired load.

BRIEF SUMMARY OF THE INVENTION

In exemplary embodiment of the invention, an apparatus and method are provided for clearing a railroad track of contaminants, such as snow and other contaminants, including a control system having a plurality of conditions required for contaminant clearing and a compressed air system mounted on a locomotive for clearing the railroad track of contaminants. The compressed air system receives instructions from the control system. Exemplary conditions comprise engine speed, notch condition, tractive effort, temperature, locomotive speed and horn and bell conditions. The compressed air system includes a source of compressed air, one or more pipes, and a nozzle mounted at an end of each pipe located a way from the compressor, in proximity to the rail and aimed at the rail ahead of a traction axle of the locomotive. The nozzle(s) is (are) placed at distance above the rail commensurate with the wheel diameter of the traction axle.

The control system may further comprise a learning system that evaluates an effect on tractive effort. The learning system measures the tractive effort at transition points of turning on and turning off the compressed air system to determine the effect on tractive effort.

These and other features and advantages of the present invention will be apparent from the following brief description of the drawings, detailed description, and appended claims and drawings.

DETAILED DESCRIPTION OF THE INVENTION

There are two fundamental elements of locomotive adhesion capability. The first is the ability of the rail to support various levels of adhesion due to various parameters and contaminants. For example, the available adhesion on a dry rail versus an oiled rail is more than twofold. The second element is the utilization of the available adhesion. When a control system is problematic, it can produce inadequate adhesion levels even on high-friction dry rail. The presence of snow on a rail can quite obviously create serious adhesion problems due to the first element.

An air compression system used to generate the compressed air that blows snow and other contaminants out of the way is part of the air compression system used in a locomotive.

Figure 1:
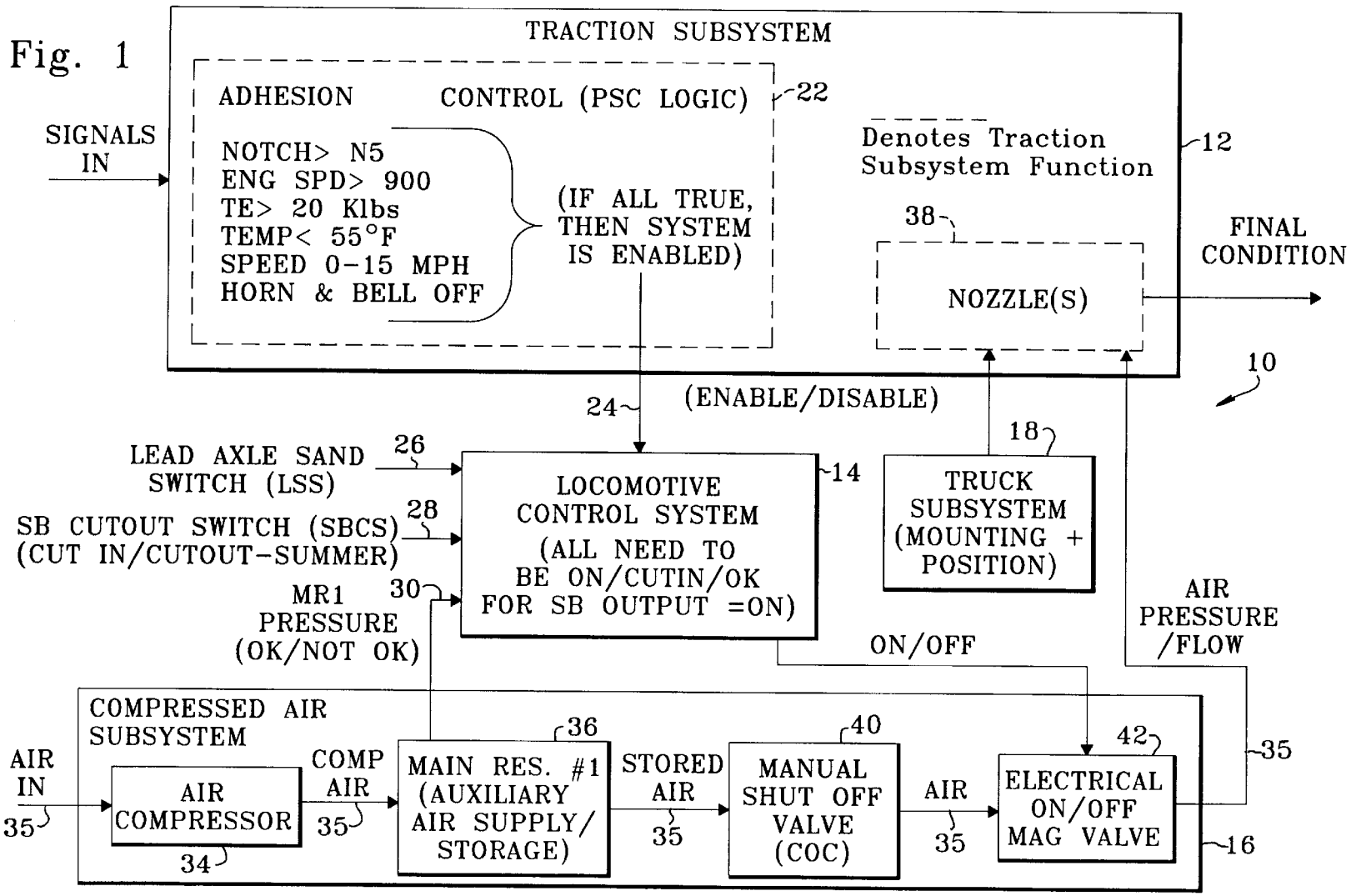
FIG. 1 is a system block diagram of a first embodiment of the invention illustrating a control system.

A control system 10 is illustrated in FIG. 1. The control system comprises several subsystem parts of various systems of the locomotive. These include a traction subsystem 12, a portion of a locomotive control system 14, a compressed air subsystem 16, and a truck subsystem 18.

An important element of the control system is the adhesion control portion 22 of the traction subsystem 12. This control portion has inputs representing a plurality of conditions for operation of the control system. Exemplary inputs include the following: Notch (e.g. greater than N5); Engine Speed (e.g. greater than 900 RPM); Ambient Temperature (e.g. less than 55° F.); Tractive Effort (e.g. greater than MPH) and the Horn & Bell (off). If the indicated conditions are met, an enabling output (Enable/Disable) 24 to the Locomotive Control System 14 is provided. The values listed above are exemplary and may be adjusted to meet the operational requirements of a particular railroad, including its climatological or geographical location.

In addition to the Enable/Disable signal 24 the Locomotive Control System 14 has input signals including the following: a Lead Axle Sand Switch (LSD) Signal 26; a Cut-In Cut-Out Switch (Cut-Out for summer) Signal 28; and MR1 Pressure (OK/Not OK) signal 30. The MR1 Pressure represents the pressure level in the main reservoir #1 of the compressed air system 16. If there is insufficient pressure in this reservoir, it is undesirable to activate the control system. In the exemplary embodiment, the Locomotive Control System 14 needs all of the above inputs to be on or enabled or cut in for the control On/Off output 32 of the Locomotive Control System 14 to be on. The On/Off Output is the control element that instructs the compressed air system to activate the actual rail cleaning operation by operating a magnet valve in the air stream 42.

The Compressed Air Subsystems 16 includes an Air Compressor 34 which provides Compressed Air to Main Reservoir #1 (36), which is part of an auxiliary air supply storage that provides stored air to nozzles 38 via a Manual Shut Off Valve 40 and an Electrical On/Off Magnetic Valve 42. The arrows in the Compressed Air Subsystem block 16 represent flow of air through pipes 35 of the Subsystem. The Electrical On/Off Magnetic Valve 42 is activated by the On/Off control line 32. The Manual Shut Off Valve 40 is located on the outside lower part of the locomotive and is accessible by a worker standing along side the locomotive while stationary. The Cutout Switch is preferably located above deck and accessible by the engineer or a maintenance worker. Either or both of these switch/valve arrangements can be used to turn the rail cleaning system off for periods during which the rail cleaning system is not needed, for example during the summer months. Such controls prevent accidental use of the rail cleaning system when the climatic conditions are such that it is highly unlikely that there is a need for the rail cleaning system.

Figure 2:
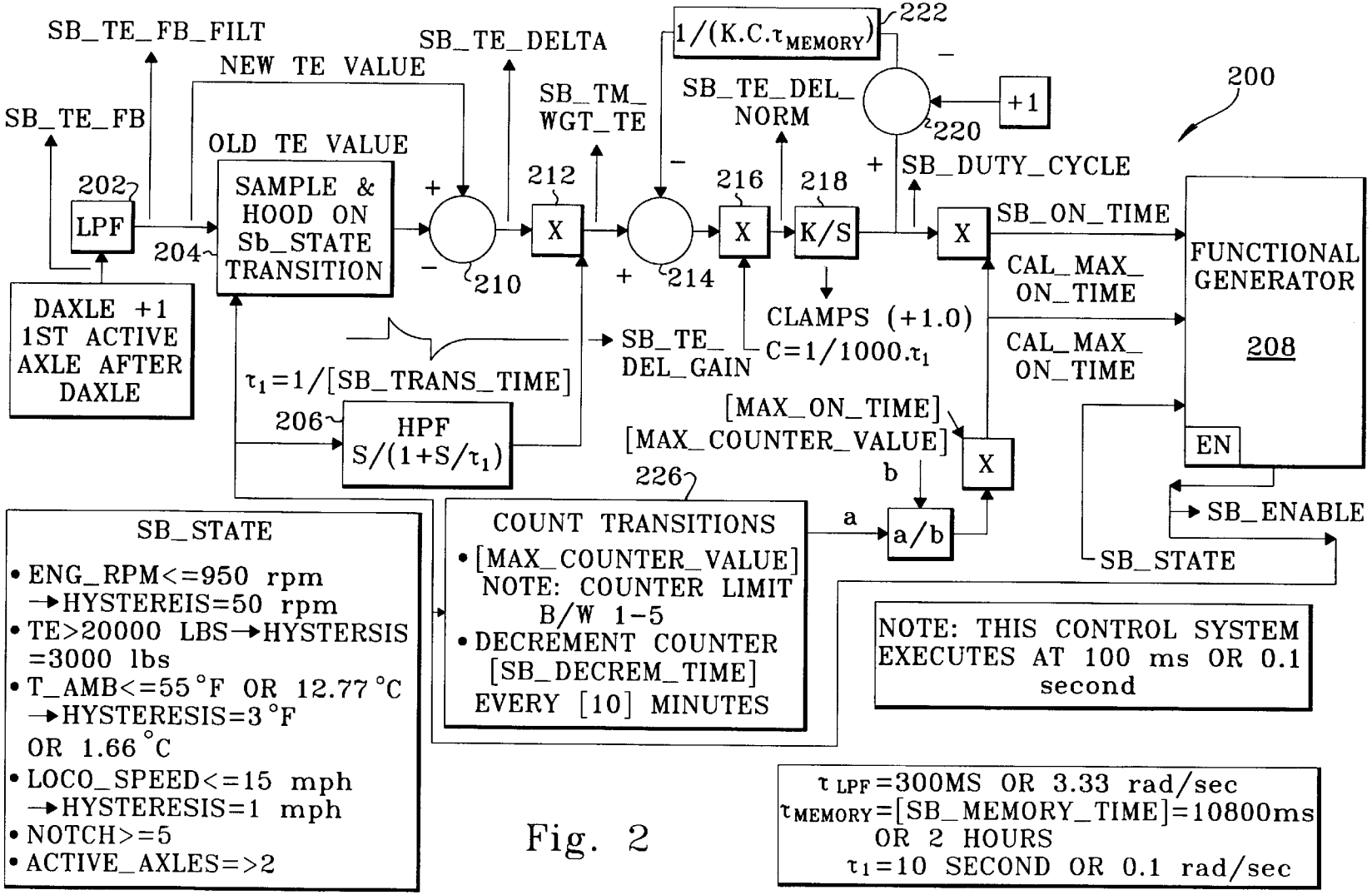
FIG. 2 is a block diagram of a second embodiment of the invention illustrating a learning control system.

FIG. 2 illustrates another embodiment of the control system which uses a learning concept 200. The learning system is used to maximize the performance of the rail cleaning system in any kind of environment such as heavy snow, light snow, no snow or even rain on the rail. This control system uses an adaptive duty cycle function which changes based on the previous recorded tractive effort, the rail cleaning system state and the time since the last transition.

The purpose of adapting the duty cycle and period of activation is that the rail cleaning system should be on when it appears to be helping and off when it may adversely affect adhesion. Furthermore, the rate of increase or decrease of duty cycle depends on how much more or less tractive effort is needed as a result of using the rail cleaning system. The on duty cycle increases more rapidly when more tractive effort appears to be improved by the rail cleaning system function. The on duty cycle increases more slowly when there is less improvement in adhesion. An adverse reaction likewise decreases the on duty cycle and increases the off duration.

During the normal mode, tractive effort of the lead axle will be used to calculate the rail cleaning system performance. When the lead axle is used or derated for other functions, the first fully performing axle's tractive effort will be used, as indicated in block 201. The performance is measured by whether the rail cleaning system is improving tractive effort, not improving the tractive effort nor neither helping or hurting the tractive effort. The tractive effort is filtered by a low pass filter 202. The output of low pass filter 202 is the input of a sample and hold system 204 which remembers the old value and clamps the new value after a period of time.

A high pass filter 206 is used to make sure that the more heavily weighted data samples are taken close to system transitions than those occurring further in time from the transition. A Count Transition system 226 is used to force more transitions to collect more data points when it is first on and decrease the on/off cycle as the rail cleaning system increases the confidence. An Auto decrement circuit is used to decay the system duty cycle memory slowly.

A functional generator 208 determines the rail cleaning system period from the following inputs: MIN_ON_TIME, MAX_ON_TIME, SB_STATE and MAX_OFF_TIME, as described herein below.

Operation of FIG. 2 is described as follows, with all values given being exemplary only for purposes of illustration. Learning system 200 receives a first input SB_TE_FB signal from the first active axle. This SB_TE_FB represents tractive effort feedback. SB_TE_FB is coupled to a Low Pass Filter LPF 202 that provides a filtered version of SB_TE_FB that has a time constant similar to the time constant of the High Pass Filer (HPF) 206 discussed later. The output of the low pass filter 202, $SB_TE_{13}$ FILT is coupled to a Sample & Hold 204 on SB_STATE transition device. Certain SB_STATE conditions required for operation of the rail cleaning system are as follows with the given values being exemplary only. The engine RPM is greater than or equal to 950 RPM with a hysterisis value of 50 RPM. The tractive effort is greater than 20,000 pounds with a hysterisis value 3000 pounds. The ambient temperature is less than or equal to 55° F. or 12.77° C. with a hysterisis value of 3° F. or 1.66° C. The locomotive speed is less than or equal to 15 miles per hours with a hysterisis value of 1 mile per hour. The Notch position is equal or greater than five. The number of active axles producing tractive effort in the locomotive is at least two. The sample and hold circuitry 204 receives instruction as to when to sample and when to hold from the SB_ENABLE signal. The output of the sample and hold circuitry 204 is coupled to a negative input of a first summing circuit 210 and the input to the sample and hold circuit 204 is coupled to a positive input of the first summing circuit 210. The first summing circuit 210 produces a signal SB_TE_DELTA which represents the difference in tractive effort of the current and the previous tractive effort (before sample time).

A High Pass Filter 206 filters a signal representing a time switching sequence to produce positive and negative switching signals representing various timing elements from the SB_ENABLE output. The output of this high pass filter, HPF 206, SB_TE_DEL_GAIN, is coupled to a first multiplier 212. The other input of this first multiplier 212 is SB_TE_DELTA which is the output of the first summing circuit 210. This multiplier produces a SBN_TM_WGT_TE signal which represents a determination by the learning system as to the performance of the system on tractive effort. If this signal is positive, it is indicative that the rail cleaning system is having a positive effect on the tractive effort. If the SB_TM_WGT_TE is negative, it is indicative that the rail cleaning system is having a negative effect on tractive effort.

The next portion of the learning system shown in FIG. 2 is a closed loop system including a second summer 212, a second multiplier 214, an integrator 218 with limit K/S, a third summer 220, a memory device ($1/(K.C._{\tau}$Memory) 222. The integrator 218 is limited to values between 0 and 1. This closed loop produces an SB_DUTY_CYCLE signal at its output. An exemplary value for $\tau$ Memory is 2 hours. The closed loop is used if no new information has been provided by the SB_TM_WGT_TE. The closed loop provides a memory of the last status of the system. An exemplary value of this memory is such that the closed loop forgets 63% of its value in 2 hours. The importance of this memory system is for the rail cleaning system to use only relatively current information in its learning process.

The SB_DUTY_CYCLE signal is coupled to a first input of a third multiplier 224. The third multiplier's 224 second input is a signal representing CAL_MAX_ON_TIME, thus producing a signal called SB_ON_TIME which is a first input to a Functional Generator 208. The Functional Generator's 208 other inputs are CAL_MAX_ON_TIME and SB_STATE. These inputs instruct the Functional Generator 208 to produce a signal called SB_ENABLE during the on time portion of the SB_ON_TIME that is limited by CAL_MAX_ON_TIME representing the maximum on time allowed. It is also limited by the SB_STATE signal which is the result of the list of factors described above including Engine RPM, Tractive Effort, Ambient Temperature, Locomotive Speed, and Notch.

The CAL_MAX_ON_TIME signal is created by using certain count transition conditions shown in 226 including MAX_COUNTER_VALUE and B_DECREM_TIME. The purpose of the CAL_MAX_ON_TIME is to limit the on time of SB_ENABLE. This in turn limits the on time of the compressor in any portion of a track clearing cycle.

The learning system described above uses the tractive effort signal to indicate whether the snow clearing is aiding, inhibiting or having no effect on the tractive effort. It also limits the time of the use of the compressor to save wear and tear on the compressor. The control system that controls the learning has an exemplary execution time of 100ms.

Figure 3:
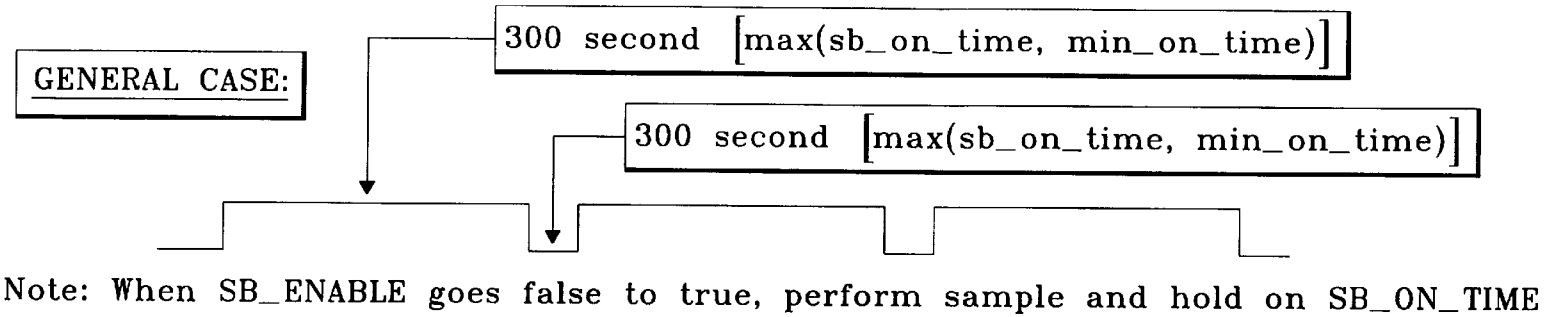
FIGS. 3–5 illustrate exemplary waveform diagrams of various SB_ENABLE signals.
Figure 4:
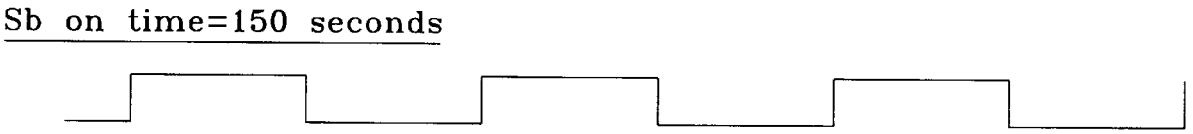
Figure 5:
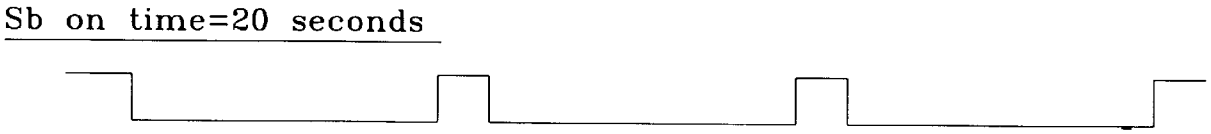

FIGS. 3–5 illustrate exemplary waveforms produced by the SB_ENABLE signal under various conditions. One such condition is when the function generator permits a maximum on time of 300 seconds with a minimum on time of 20 seconds. FIG. 3 illustrates a total 320 second on/off transition time with a 300 second on time. FIG. 4 illustrates the SB_ENABLE signal with an on time of 150 seconds and an off time of 170 seconds. FIG. 5 illustrates the SB_ENABLE signal with an on time 20 seconds and off time of 300 seconds. When the SB_ENABLE goes false to true, the sample and hold circuit 204 performs a sample and hold on SB_ON_TIME. These on/off times are exemplary and other values may be used by an operator depending on the operating conditions and climate of the particular railroad.

A rail cleaning system comprising a learning component may be used in the system in FIG. 1. The Enable/Disable line from the Adhesion Control system 20 is coupled to an EN input of the Functional Generator 208 of the learning system as described above. The SB_ENABLE signal output of the Functional Generator 208 is coupled to the Locomotive Control system 14 in place of the Enable/Disable 24 signal in FIG. 1. This permits the learning system to apply its intelligence to the output of the Adhesion Control to activate the rail cleaning system when the learning system calculates a need for the rail cleaning system to be on.

The performance of the rail cleaning system is dependent upon the alignment of the nozzle with respect to the rail, height from the rail and the angle of action on the rail. The compressed airflow onto the tracks is controlled by the mounting of the compressed air pipe and the amount of air and its pressure. The mounting of the compressed air pipe over each rail is placed before the sand pipe, just ahead of the leading axle. The placement of the compressed air pipe is such that the nozzle to the rail has a range between 4.75 inches to 6.25 inches from the rail depending upon the wheel diameter. A 42-inch wheel has a 6.25 nozzle height from the rail and a 39-inch wheel has a 4.75 inch nozzle height from the rail. An exemplary angle of action on the rail is 60° with respect to the rail looking from the side and 60° from the track looking head on. These are exemplary values and the nozzle height may vary depending on the locomotive configuration. The nozzle is aimed at the rail. An exemplary value of pressure is 70 psi with 45 CFM of airflow per nozzle. Two nozzles are used, one for each rail with an exemplary pressure of 70 psi with a combined airflow of 90 CFM. An exemplary nozzle is placed at a distance above the rail commensurate with the height of a snowplow mounted ahead of the nozzle with respect to forward movement of the locomotive.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

What is claimed is:

1. An apparatus for clearing railroad rails of contaminants causing a loss of locomotive traction from reduced adhesion of the locomotive wheels on the rails:

a compressed air sub-system mounted on a locomotive for directing compressed air onto the railroad rails in order to clear the rails;

the compressed air sub-system being operable in response to a control signal to operate in either a first mode, constituting an air delivery mode, for directing air under pressure to the rails to remove the contaminates from the rails, or a second mode, constituting a non-delivery mode, in which no compressed air is delivered;

a control system for providing control signals to the compressed air subsystem based on a calculation of loss of adhesion of the locomotive wheels on the rail from the presence of contaminates on the rail, with such calculation being based on at least two conditions relating to the rails and locomotive selected from the group of conditions comprising engine speed, notch condition, tractive effort, temperature, locomotive speed, braking conditions, time of day, geographical location, climate, and time of year;

whereby the control system sends a control signal to activate the compressed air subsystem to deliver air under pressure to clear the rails when the calculated adhesion loss exceeds a predetermined level.

2. The apparatus of claim 1 wherein the control signal is further controlled in response to operator permission.

3. The apparatus of claim 1 wherein the control system provides the activation control signal only if the engine speed is greater than a predetermined value.

4. The apparatus of claim 1 wherein the control system provides the activation control signal only if the tractive effort is greater than a predetermined value.

5. The apparatus of claim 1 wherein the control system further comprises a learning system for evaluating past effects of rail clearing operations on the locomotive tractive effort on the rails.

6. The apparatus of claim 5 wherein the learning system measures the tractive effort at time intervals before and after activating and deactivating off the compressed air sub-system.

7. The apparatus of claim 5 wherein the learning system uses a memory system that does not retain data after a predetermined time period in order to adapt to changing conditions.

8. The apparatus of claim 1 wherein the compressed air subsystem comprises:

a source of compressed air;

one or more pipes for directing the compressed air; and a nozzle mounted at an end of each pipe spaced from the source of compressed air in proximity to the rails for directing the compressed air to the rails ahead of a traction axle of the locomotive.

9. The apparatus of claim 8 wherein the nozzle is placed at distance above the respective rail commensurate with the wheel diameter of the traction axle.

* * * * *